US012790814B2

(12) United States Patent
Kandrashou

(10) Patent No.: US 12,790,814 B2
(45) Date of Patent: Nov. 10, 2026

(54) METHOD OF MODULAR BUILDING ASSEMBLY

(71) Applicant: Cuby Technologies, Inc., Wilmington, DE (US)

(72) Inventor: Aleh V. Kandrashou, Bensalem, PA (US)

(73) Assignee: Cuby Technologies, Inc., Mountain View, CA (US)

( * ) Notice: Subject to any disclaimer, the term of this patent is extended or adjusted under 35 U.S.C. 154(b) by 162 days.

(21) Appl. No.: 18/028,977

(22) PCT Filed: Jun. 14, 2021

(86) PCT No.: PCT/BY2021/000010
§ 371 (c)(1),
(2) Date: Mar. 28, 2023

(87) PCT Pub. No.: WO2022/067416
PCT Pub. Date: Apr. 7, 2022

(65) Prior Publication Data

US 2023/0332396 A1 Oct. 19, 2023

(30) Foreign Application Priority Data

Sep. 29, 2020 (EA) ..... 202000329

(51) Int. Cl.
*E04B 1/348* (2006.01)
*E04B 1/04* (2006.01)
*E04C 3/30* (2006.01)

(52) U.S. Cl.
CPC ..... *E04B 1/34823* (2013.01); *E04B 1/04* (2013.01); *E04C 3/30* (2013.01)

(58) Field of Classification Search
CPC .... E04B 1/3483; E04B 1/34823; E04B 1/346; E04B 1/343; E04B 1/34; E04B 1/2403; H05K 7/1497
(Continued)

(56) References Cited

U.S. PATENT DOCUMENTS 3,927,498 A * 12/1975 Benedetti ..... E04B 1/6812 52/262
4,033,081 A * 7/1977 Perkins, Jr. ..... E04B 1/12 411/921
(Continued)

FOREIGN PATENT DOCUMENTS

BY 6972 C1 6/2005
CN 210002601 U 1/2020
(Continued)

OTHER PUBLICATIONS

PCT International Search Report and Written Opinion, PCT Application No. PCT/BY2021/000010, Oct. 14, 2021, 18 pages.

*Primary Examiner* — Paola Agudelo
(74) *Attorney, Agent, or Firm* — Fenwick & West LLP

(57) ABSTRACT

The method of the invention optimizes logistics of prefabricated modules delivery to a building site. The method of the uses the pre-fabricated sets of the multiple elements prepared at the building site including: the modules, the slabs with apertures for the installation of columns, the foundation with capping, and the columns which are preferably. The columns are fabricated with the internal channels for water runoff. During installation the columns are joined by the diagonal braces. The roofing slab modules are mounted to provide connection with the internal channels in the columns. The utility modules are provided with a control system having the software to allow control of the electrical and water supply systems.

7 Claims, 4 Drawing Sheets

(58) Field of Classification Search
USPC ..... 52/79.1
See application file for complete search history.

(56) References Cited

U.S. PATENT DOCUMENTS

| | | | | |
|---|---|---|---|---|
| 4,106,243 | A * | 8/1978 | Horn | E04B 1/3483 52/16 |
| 4,644,708 | A * | 2/1987 | Baudot | E04B 1/3483 52/79.9 |
| 4,833,841 | A * | 5/1989 | Ellington, III | E04B 1/3483 52/690 |
| 4,899,497 | A * | 2/1990 | Madl, Jr. | E04B 1/0007 52/126.6 |
| 5,439,716 | A * | 8/1995 | Larsen | E06B 3/66314 52/786.13 |
| 6,481,172 | B1 * | 11/2002 | Porter | B32B 5/18 52/794.1 |
| 10,487,493 | B2 * | 11/2019 | Collins | E04B 5/12 |
| 10,837,168 | B2 * | 11/2020 | Rittmanic | E04B 1/34321 |
| 2004/0231256 | A1 | 11/2004 | Ohnishi | |
| 2010/0263308 | A1 * | 10/2010 | Olvera | E04C 2/521 52/220.2 |
| 2011/0296778 | A1 * | 12/2011 | Collins | E04C 2/521 52/745.1 |
| 2015/0007522 | A1 * | 1/2015 | Dobija | E04B 9/30 52/653.1 |
| 2016/0160515 | A1 * | 6/2016 | Wallance | E04F 10/10 52/745.02 |
| 2019/0277016 | A1 | 9/2019 | Ahern | |
| 2021/0172164 | A1 * | 6/2021 | Holm | E05B 63/0065 |

FOREIGN PATENT DOCUMENTS

| | | | |
|---|---|---|---|
| RU | 2247812 | C2 | 3/2005 |
| RU | 2312191 | C1 | 12/2007 |
| RU | 2717600 | C1 | 3/2020 |
| SU | 694614 | A1 | 10/1979 |
| WO | WO 2013/110616 | A1 | 8/2013 |
| WO | WO 2019/088948 | A2 | 5/2019 |

* cited by examiner

METHOD OF MODULAR BUILDING ASSEMBLY

FIELD OF THE INVENTION

The invention relates in general to the field of construction, and in particular it relates to the method of building construction using prefabricated structural elements.

DESCRIPTION OF THE PRIOR ART

The practice of using various types of prefabricated elements in the construction of buildings is widely known, including the idea of construction using prefabricated building modules. Modules, such as for example, a bathroom, a kitchen, etc. are suitable for installation in of the known module a building complexes, including a multi-storey building.

Patent BY No 6972 discloses a method of erecting a multi-storey building having a frame formed by multi-storey rectangular columns, prefabricated rectangular pillars with through rectangular holes in their middle for the passage of the columns and butt connection with them. The method includes installation of columns along the alignment axes, installation of technical equipment at each level on the lower floor (or basement floor), installation of floor slabs for the next level. The installation cycle is repeated until the building is completed.

The essential drawback of this method is in the need for multiple re-installation of the assembly and technical equipment, which slows down the speed of the building assembly.

A method of mounting a modular building, including the installation of a room module inside the frame of the building is also known [see RU No 2312191 C1]. According to the method, the room module is installed with gaps relative to the outer walls of the frame, and such gaps are closed in the area of the window and door openings of the room module and the corresponding window and door openings of the frame. At the same time, the room module is fastened to the frame, and the gaps are filled with insulation after installing the room module inside the building frame, or the insulation is preliminarily fixed at least on the outer surfaces of the room module, or the insulation is pre-fixed on the inner surfaces of the building frame. The size of the gaps between the walls of the room module and the walls of the frame is chosen in the range of 10-50 cm, depending on the climatic conditions of the area where the building is located and the efficiency of the insulation used, and foam material, or bulk material, or fibrous material, or a combination of foam and/or loose and/or fibrous materials. The surface of the insulation layer adjacent to the outer wall is made of a material with waterproofing properties, and a non-woven waterproofing material is placed between the insulation layer and the outer wall, while additionally a membrane material is placed. This makes it possible to pass gas mixtures from the interior to the exterior of the building and prevent penetration gas mixtures in the opposite direction. The room module has built-in utilities, which are provided in the form of electrical wiring and/or cold or cold and hot water supply systems, and/or heating and/or ventilation, and/or a television and/or telephone and/or radio communication system, and/or connection to the Internet. The room module is made with a technological channel for utilities, the outlet of which is located in the lower part of the room module, and at the base of the frame there are provided mating connectors or technological holes with the possibility of connection with the corresponding engineering communications of the technological channel of the room module when it is installed in the building frame. Technological channels for engineering communications are fixed on the inner surface of the frame in the gap between the wall panel of the room module. On the surfaces of the technological channels facing the wall panels, guide elements are made or fixed, the counterparts of which are made or fixed on the outer surfaces of the wall panels of the room module for its precise installation in the frame.

There is also known a method of connecting modular structures to form modular building complexes [US Patent Publication 2019/0277016 A1]. The method includes mounting the first flange the first segment of the modular corridor, and the first flange contains a plurality of flange elements connected together using one or more cube corner nodes. Next, a second flange of the second segment of the modular corridor is mounted, with the second flange complementing the first flange, and the second flange containing a plurality of flange elements connected together using one or more cubic corner nodes. Then, the first flange and the second flange are connected with the flange-to-flange surface orientation, and a plurality of service pipelines are also connected, passing from the first flange of the first segment of the modular corridor, at least to the second flange of the second segment of the modular corridor. Installation of the connection of the first flange and the second flange with the flange-to-flange surface orientation includes the connection of the first flange and the second flange in the flange with the face-to-flange orientation using mechanical fasteners through additional connecting holes. A plurality of service pipelines are also connected, which includes the connection of at least one of: an electrically conductive channel, a signal channel for control and instrumentation, a water pipeline, a sewer/waste liquid channel, a heating pipeline, ventilation and an air conditioning pipeline (HVAC) and a safety signal path between the first flange of the first segment of the modular corridor and at least the second flange of the second segment of the modular corridor. According to the method, a modular corridor segment containing a side flange is connected to an additional end flange of an adjacent modular cubic structure and a plurality of service channels extending from the end flange of the corridor segment is additionally connected to at least the side flange of the segment corridor.

One of the essential drawbacks of the known prior art in the field of construction of buildings using modular structures is the relatively long construction time of buildings, due to the logistics of delivery of modules and, accordingly, increased transportation and construction costs for the construction of buildings.

WO 2013/110616 which discloses another construction method is considered to be one of the most pertinent prior art references known to the applicant. The method includes assembling a part of a building, wherein a prefabricated module is preliminarily formed in the form of a rectangular parallelepiped, placing four walls between the floor slab and the roof slab. At least one compartment is provided inside the rectangular parallelepiped and a wet area is created in the compartment by applying waterproof layers to the inner sides of the walls and the floor slab. A vertical through ventilation shaft is formed, and at least one shaft S is formed in the compartment. In these shafts and inside a rectangular parallelepiped, appropriate technical means are laid, including at least one switchboard, a power cable, and/or at least one low-voltage electrical cable connected, if necessary, to a switchboard, and/or at least one water pipe and/or at least one sewer pipe and/or a water heating system and/or a cooling system, and/or fire protection system. Further, static connectors are attached to the corresponding side surface of the prefabricated module, and panels for forming interior walls are made and equipped with static connectors. Panels for forming exterior walls, slabs for forming roofs and floors are manufactured and equipped with dynamic connectors. The internal walls are formed by connecting the static connectors of the manufactured panel with the static connectors of the prefabricated module. The manufactured panels are connected with free edge sections, forming the outer walls, placing them opposite the prefabricated module. The manufactured slabs are connected to the prefabricated module with dynamic connectors, forming a floor and a roof. The prefabricated module is made with a length of about 6.5-7.0 m, a width of about 2.5 m and a height of about 3.0 m, while forming the above-mentioned two compartments inside the prefabricated module and forming two shafts S, and they are laid from one shaft S power cable, low voltage electrical cable, and a water pipe and a sewer pipe into another shaft S. A ventilation shaft is formed in each compartment, and both shafts S are combined into one. A bath is installed in the department and, if necessary, a mini kitchen in a rectangular parallelepiped, and furniture and/or devices for people with disabilities are installed in the prefabricated module, while at least two doorways are made in the prefabricated module, located in opposite walls.

The drawback of this prior art reference is the low versatility due to the inability to use sets of typical building elements to implement a wide range of design solutions. The disadvantage is also the lack of mobility in the placement of production equipment, which occupies large areas and, accordingly, there is inconvenient logistics associated with the delivery of prefabricated modules to the construction site. The disadvantage is also the inability to assemble a part of the building using technical means with an electronic system for centralized control of electrical and water supply and sewerage, heating, cooling and fire safety systems.

SUMMARY OF THE INVENTION

One of the goals of the invention is to eliminate the prior art drawbacks and to accelerate the buildings construction process/method.

The technical result/objection/goals of the invention is in the use of a wide range of design solutions selected from a set of typical elements in the construction of buildings. The technical result/goals of the invention are also achieved by optimizing the logistics of delivery of prefabricated modules to the construction site, as well as by reducing production, transportation and construction costs.

The technical result/objections/goals of the invention are achieved by providing a method of assembly of modular buildings which utilizes pre-fabricated arrays of a plurality of modules, panels with openings for installation of columns, a foundation with a grillage, columns made with the ability to absorb the bearing load. The wall modules are made with openings for windows and doors. The method of the invention also utilizes ground floor panels modules, floor panels modules and roof panel modules, which are mounted on columns. The wall panel modules are placed between the floor panel modules and the roof panel modules, wherein the wall modules are installed on facade modules and external communication modules. Carrying out installation of inter-floor areas, stairs and insulation with waterproofing are also contemplated. The installation of technical means/arrangement ensuring the functionality of the electric water supply, sewerage, heating and fire safety systems according to the invention are carried out. Before the steps of a modular building assembly, arrays of a plurality of modules are preferably made at a construction site. The columns are made with internal channels for water drainage, and during installation, the columns are connected to each other in the necessary places with diagonal braces. On the other hand, the gutters of the roof slab modules are mounted with the ability to connect to the internal channels in the columns to ensure water drain from the roof of the building. The sections of internal partitions are mounted and the connecting communication modules for technical means are placed, to connect them on the floor slab modules. The roof panel modules, columns, air conditioning units and a shading facade are attached to the wall modules. The technical arrangements of the communication modules are supplied with a control system, having the software designed to provide control of the electric water supply, heating sewerage and fire safety systems.

The foundation is carried out on piles, which are buried to the set design depth, or at the depth of any other structure, depending on the soil. Panels made of, for example, reinforced concrete or other structures, are laid on the foundation grillage.

The method of the invention further includes installation of the columns and diagonal braces between therebetween. The floor modules, staircase modules, inter-floor staircases, staircases, vertical communication modules and the shading facades are mounted up to the installation of roof panel modules on the columns of the last floor.

The shading facade is mounted on the wall modules, while double-glazed windows are installed in the openings for the windows of the wall modules (15). Finish of the foundation having the grillage is carried out with decorative panels made, for example, with a polyisocyanurate foam.

BRIEF DESCRIPTION OF THE DRAWINGS

Disclosure of the invention is presented in combination with the drawings of FIGS. 1-8.

DETAILED DESCRIPTION OF THE INVENTION

Figure 1:
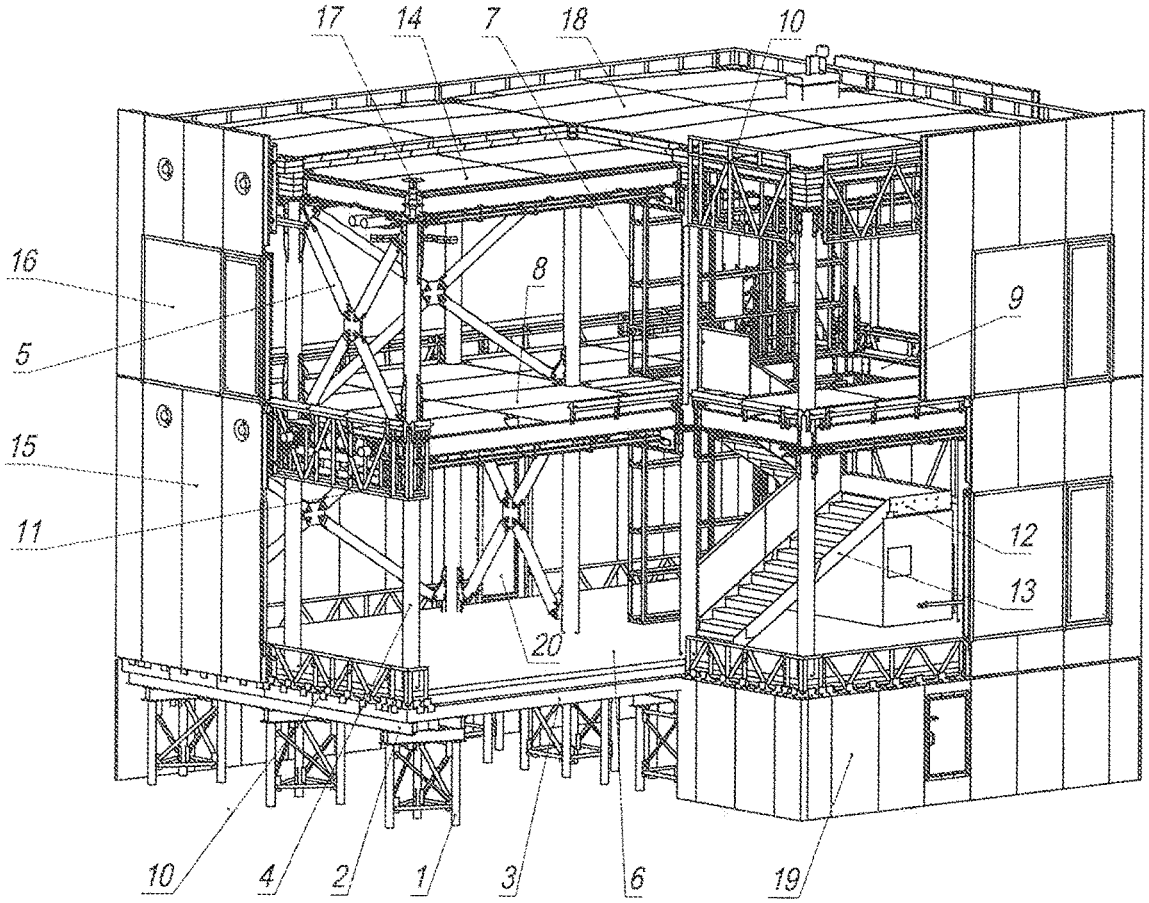
FIG. 1 is a general view of a modular building with structural elements.
Figure 2:
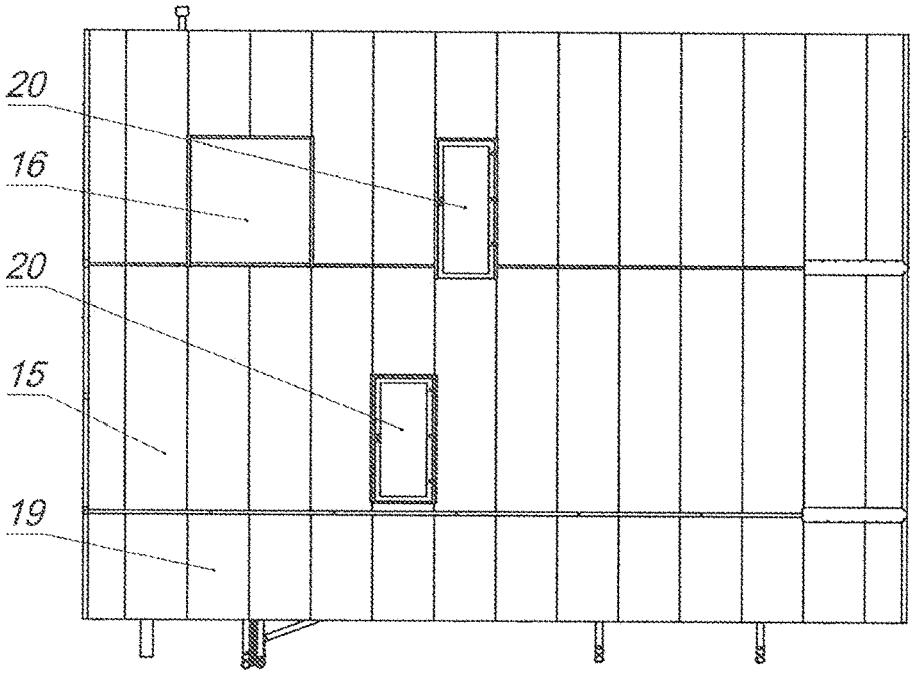
FIG. 2 is a schematic end view of a modular building.
Figure 3:
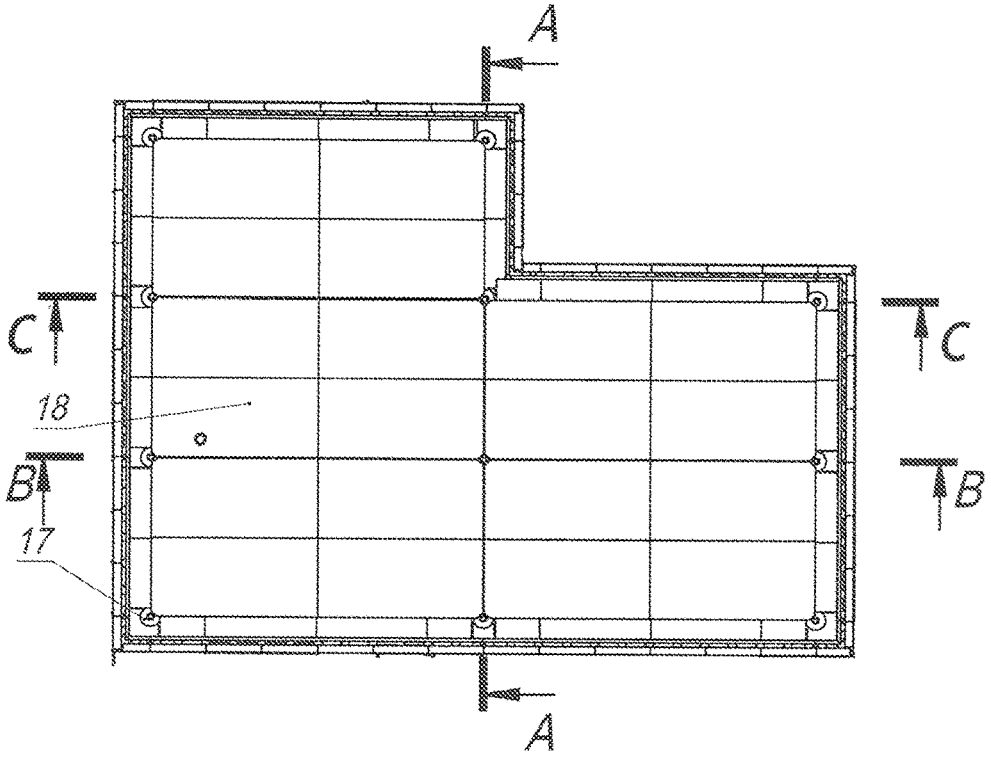
FIG. 3 is a top view of a modular building.
Figure 4:
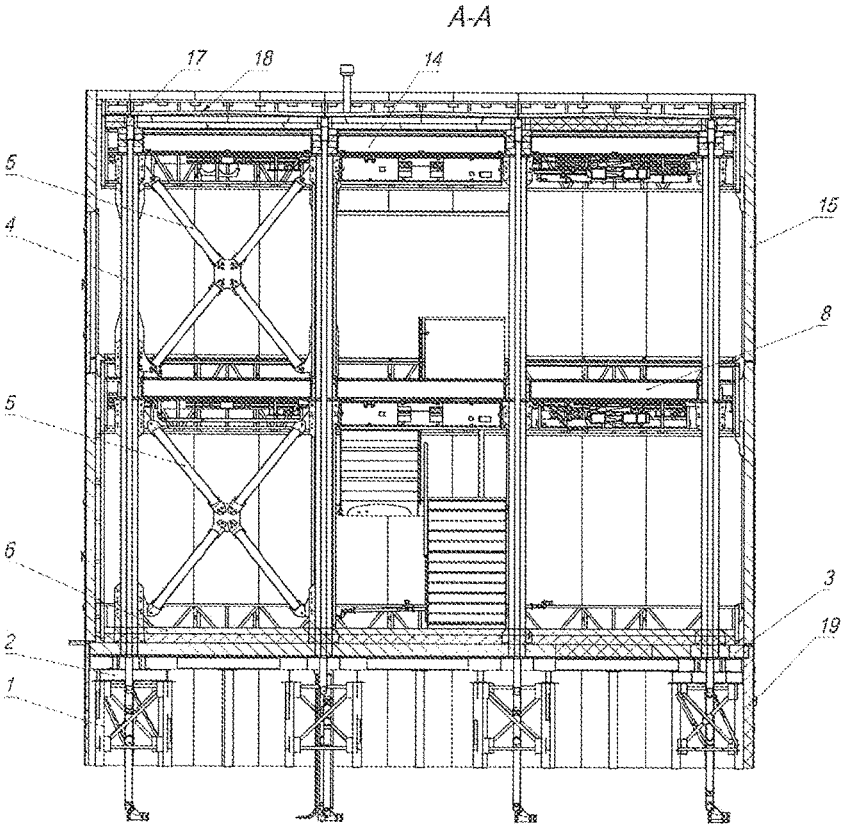
FIG. 4 is a sectional view of a modular building along section line A-A of FIG. 3.
Figure 5:
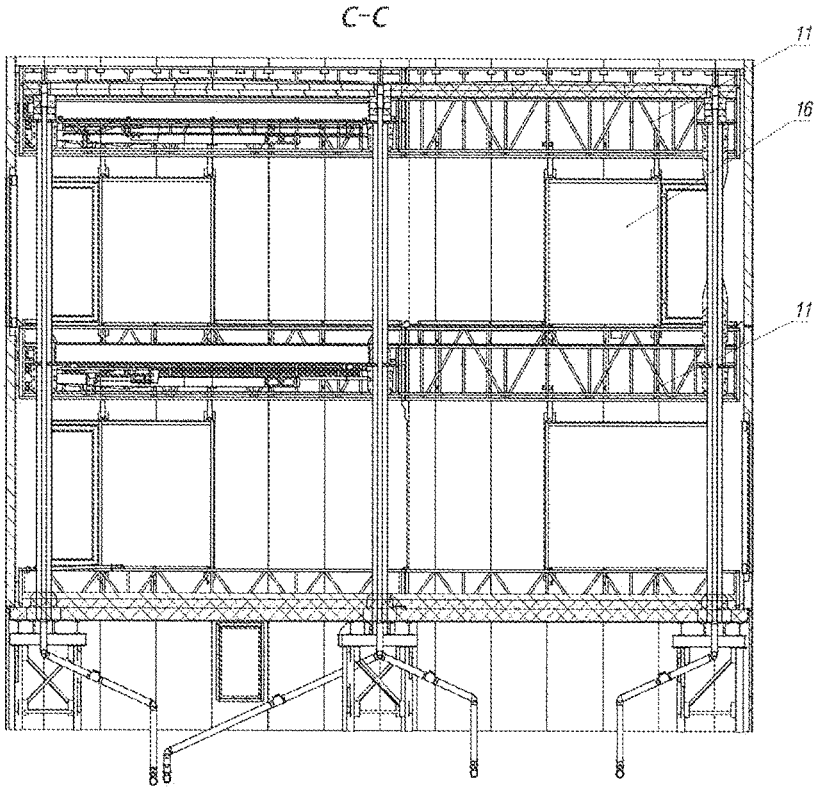
FIG. 5 is a sectional view of a modular building along section line C-C of FIG. 3.
Figure 6:
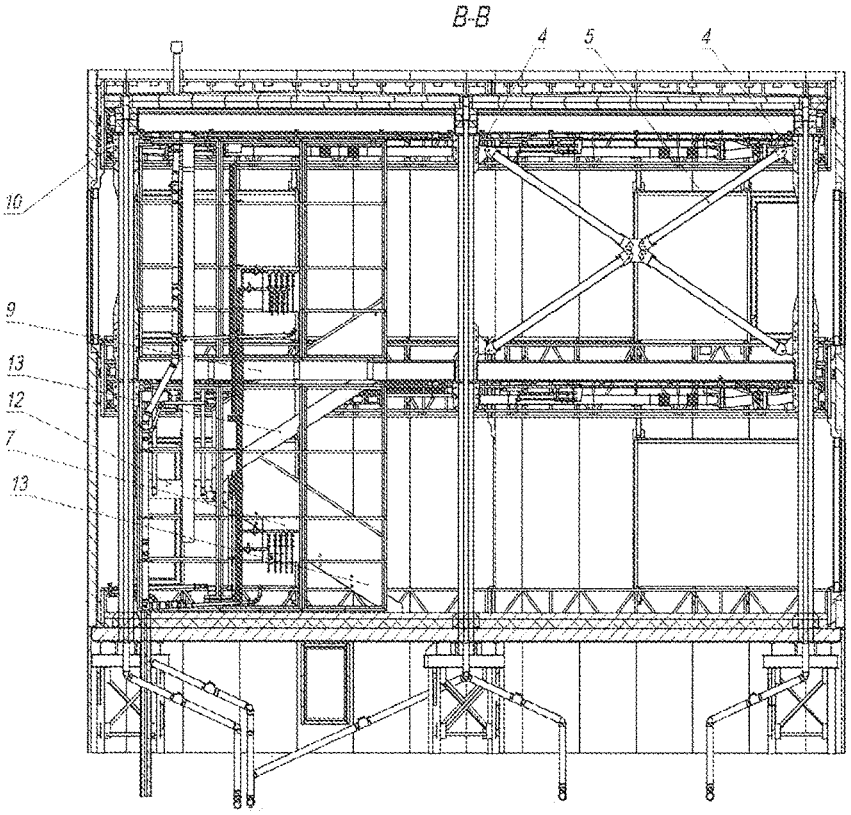
FIG. 6 is a section view of a modular building along section line B-B of FIG. 3.
Figure 7:
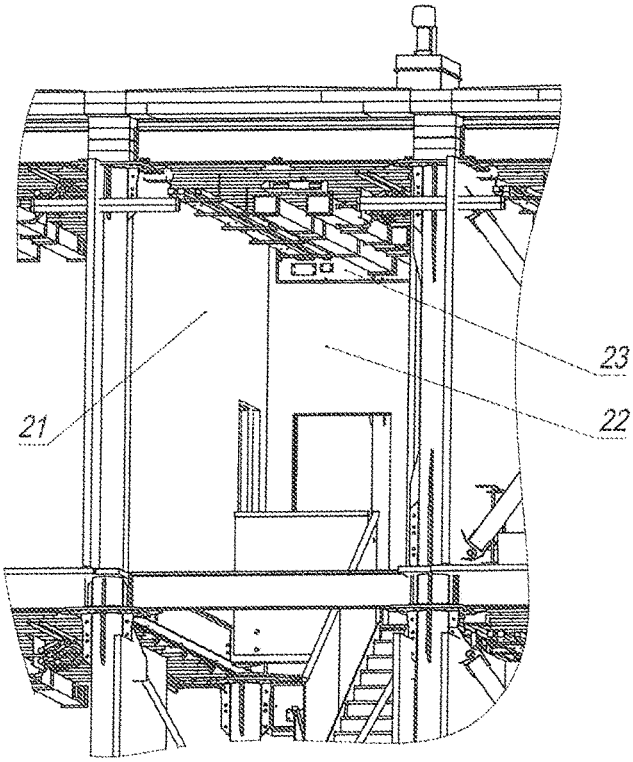
FIG. 7 is a view of elements of sections of internal partitions with a connecting communication module.
Figure 8:
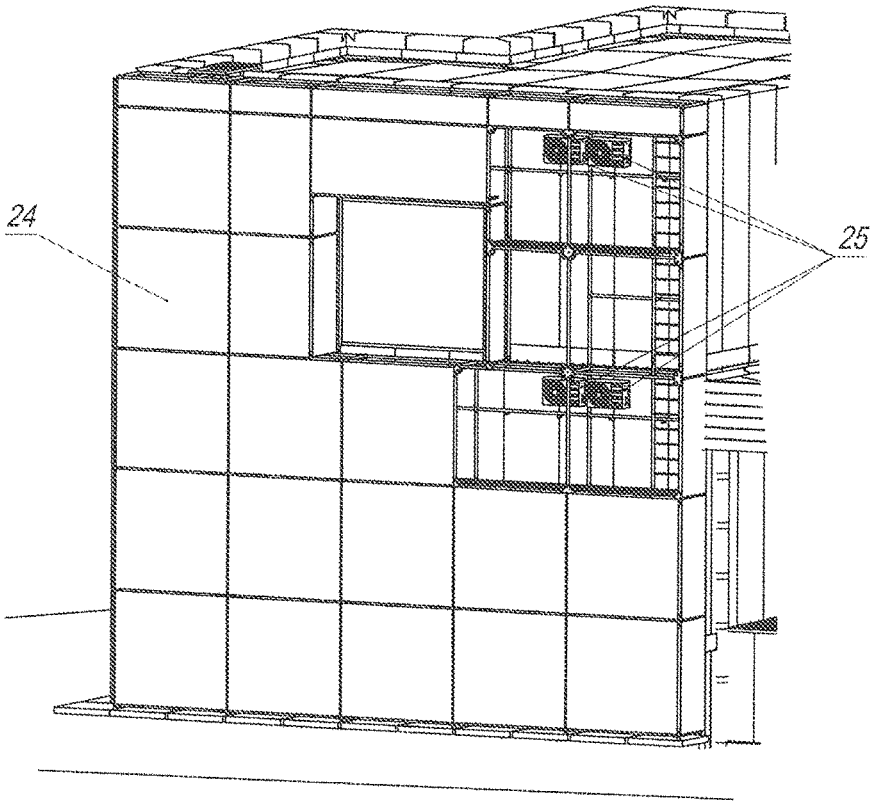
FIG. 8 illustrates a fragment of the wall of a modular building with an installed shading facade and air conditioning units.

The modular building used in the method of the invention comprises: piles 1; a foundation with a grillage 2 which is lined with decorative panels 19 made of, for example, poly-polyisocyanurate foam (PIR panels); slabs 3, which can be made for example, of reinforced concrete, or can be in the form of other structures with windows/openings for installing load bearing columns 4 having internal channels 17 for drainage water; wall modules 15 with openings for windows 16 and doors 20; sections 21, 22 of internal partitions; inter-floor platforms 12; stairs 13; blocks of air conditioners 25; a shading facade 24, which is connected to wall modules 15. The modular building further comprises an array of multiple modules as follows:

inter-floor overlap modules 6 for the first floor,
vertical communication modules 7,
inter-floor overlap modules 8 for a floor,
flights of stairs modules 9,
facade modules 10,
wall modules 15,
roof slabs modules 14,
external communication modules 11, and
connecting communication modules 23.

Further, an insulation with waterproofing 18 is placed on the modules 14 of the roof slabs. Also provided technical means/arrangements with a control system containing software to ensure the operation of electric water supply, sewerage, heating and fire safety systems.

The method of the invention is implemented in the following manner. For the erection of a modular building, before its assembly, a set of equipment, arranged as a mobile plant, is placed directly at the construction site. The mobile plant is provided to manufacture typical elements of the building including but not limited to arrays of many modules 6, 7, 8, 9, 10, 11, 14, 15, 23, and other building structural elements. Such positioning of the plant allows the method of the invention to optimize the logistics of delivery of prefabricated modules, so as to reduce the transport costs and the production construction costs.

Further, at the mobile plant at least the following building elements are manufactured, including but not limited to: the inter-floor overlap modules 6 for the first floor; the vertical communication modules 7; the inter-floor overlap modules 8 for a floor of intermediate floors; the flights of stairs modules 9; the facade modules 10; the wall modules 15; the roof slab modules 14; the external communication modules 11; the connecting communication modules 23. The mobile plant also accommodates manufacturing of the plates 3, such as for example, reinforced concrete plates with windows for the installation of columns; the columns 4 with internal channels 17 for water drainage; the wall modules 15 with the openings for windows 16 and doors 20; the sections 21, 22 for internal partitions; the inter-floor areas 12; the stairs 13; the air conditioning units 25; the shading façade 24. The inter-floor overlap modules 6 for the first floor slabs; the inter-floor overlap modules 8 for a floor; the roof slabs modules 14 and the flights of stairs modules 9 are manufactured with at least the following types of communications: ventilation, electrical wiring, fan coil, etc., which are mounted at the bottom of the indicated modules. The wall modules 15 are made of the following types: solid from decorative panels 19 (PIR panels made of polyisocyanurate foam), with the openings for the windows 16 and the doors 20. Internal partitions are made as basic elements for assembly—section 21, 22 of internal partitions. The shading facade 24 is provided for subsequent shielding of air conditioners 25 in the walls of the building and the convenience of their maintenance.

At the same time, a foundation pit is developed, for the foundation having a grillage 2, in the form of screw-type or vibro-submersible piles 1, which are submerged at the predetermined design depth. The foundation can be also made having other conventional designs, depending on the properties of a specific soil. The reinforced concrete or other slabs 3, according to the design of a building, are laid, for example, on the grillage 2 of the foundation. The foundation grillage 2 can be made of metal profiles or a concrete. After formation of the foundation, a modular building is assembled, using applicable technological brackets, other building elements and tools for mounting an array of multiple modules 6, 7, 8, 9, 10, 11, 14, 15, 23 and other structural elements of the building.

In the method of the invention the assembly of the building is carried out in the following manner. The slabs 3, which can be, for example, in the form of reinforced concrete elements with windows, are laid on the foundation having the grillage 2 for the installation of the load bearing columns 4. It is also possible to use the slabs 3 having different designs, such as for example to use the metal slabs. The first floor columns 4 are installed and reinforced/strengthened at the predetermined places by the diagonal braces 5. The floor modules of the first floor 6 are laid on the slabs 3 and the vertical communication modules 7 are installed. The inter-floor overlap modules 8 for a floor, the flights modules 9 of stairs, the facade modules 10 and the external communication modules 11 are mounted on the load bearing columns 4. Then, the inter-floor platforms 12 are installed and the stairs 13 are mounted.

Further, the above discussed steps of the assembly method of the invention are repeated for the installation of the next floor, wherein the columns 4 are installed and reinforced, according to the method with the diagonal braces 5. The inter-floor overlap modules 8 for a floor, the vertical communication modules 7, the inter-floor staircases 12, the staircases 13, the facade modules 10 and the external communication modules 11 are mounted. After the last floor assembly, the roof modules 14 are installed and fastened on the load bearing columns 4.

Upon each floor of the building assembly, the wall modules 15 are installed, utilizing the brackets, on the facade modules 10 and the external communication modules 11. This approach takes place beginning from the first floor and continues to the last upper floor. After installation of the wall modules 15 of two adjacent floors, the joint area between them is closed. Then, glass units of windows 16 or doors 20 are installed on the lower floor in the openings of wall modules 15. Alternatively, the glass units can be mounted within the modules 15 having the pre-installed windows 16 or doors 20. This depends on the type of the wall module 15.

After covering the last floor with the roof modules 14, drains are mounted on them, which are connected to the internal channels 17 for draining water in the columns 4. The roof modules 14 are covered with gravel, crushed stone or pebbles. Then, the insulation and the waterproofing are laid, and the closure of the joints between the structural elements is completed.

In the method of the modular building assembly of the invention sections 21, 22 of internal partitions are assembled and mounted on each floor, and the doors 20 are installed in the doorways. Further, switches, sockets, alarm elements, etc., as well as connecting communication modules 23 are mounted. Technical means/arrangements located in the connecting communication modules 23, the vertical communication modules 7 and the external communication modules 11 are equipped with a control system having the software which is designed to provide control of the electric water supply systems, the heating sewerage and fire safety. The software is provided/arranged by a specially designed computer program with a software and hardware complex.

The assembly of the modular building is completed by finishing the foundation having the grillage 2 by installing the decorative panels 19 made of, for example, from polyisocyanurate foam (PIR panels). The shading facade 24 is installed either on one side or on all sides of the building.

The shading facade 24 is connected to the panels of the wall modules 15 having also the mounted air conditioner units 25. The shading facade 24 can be also provided with magnetic mounts. Depending on the type of a building design, the building structure can also be assembled without the shading facade 24.

The method of the modular building assembly of the invention is characterized by a high speed of building erection due to the manufacture of building elements directly at the construction site using a special equipment. This eliminates the need to adjust the elements to each other. The method of the invention is also characterized by versatility, which allows a user to develop a wide range of construction projects from a set of typical elements comprising an array of multiple modules 6, 7, 8, 9, 10, I, 14, 15, 23.

A mobile plant with a set of equipment for the construction of building elements occupies a small part of the construction site having location mainly based on the logistical considerations. The developed construction technology according to the invention provides for the use of an accessible and interchangeable range of building materials that are widespread. The developed technology of the invention also does not exclude the use of building materials manufactured under the standard factory conditions.

As a result of the combination of the above discussed advantages, the maximum speed of erection of modular buildings and a significant reduction in production, transport and construction costs are achieved.

The invention claimed is:

1. A method of forming a modular building assembly, the method comprising:

receiving, at a construction site, a plurality of pre-fabricated elements including structural modules and communication modules;

installing one or more of the structural modules to form a load-bearing column and a roof structure, the load-bearing column pre-fabricated with a first internal channel for water drainage and the roof structure pre-fabricated with a second internal channel for water drainage;

coupling the load-bearing column with the roof structure to connect the pre-fabricated first internal channel and the pre-fabricated second internal channel;

installing a plurality of communication modules to the one or more structural modules that form the load-bearing column from an internal side of the load-bearing column, the plurality of communication modules pre-fabricated with housing configured to receive equipment to provide a plurality of utility operations, wherein the plurality of utility operations includes two or more of electricity, water supply, sewerage, heating, or fire safety service; and integrating a centralized control system with the plurality of communication modules, wherein the centralized control system is configured to control the plurality of utility operations.

2. The method according to claim 1, wherein the modular building assembly further comprises (i) a foundation comprising piles embedded to a predetermined depth and (ii) floor slabs placed on a grillage structure formed of reinforced concrete.

3. The method according to claim 1, further comprising installing a roof module on columns of an uppermost floor, wherein the roof module is a pre-fabricated element.

4. The method according to claim 3, wherein, prior to installing the roof module, the method further comprises:

installing a plurality of load-bearing columns including the load-bearing column;

installing diagonal braces between the load-bearing columns;

installing floor modules, stair modules, and inter-floor landings; and and installing vertical communication modules and shading facades.

5. The method according to claim 1, wherein the modular building assembly further comprises a shading facade that is mounted on wall modules after double-glazed windows are installed in window openings of the wall modules.

6. The method according to claim 1, wherein the modular building assembly further comprises a foundation, and wherein the foundation includes a grillage having decorative panels made from polyisocyanurate foam.

7. The method according to claim 1, wherein the communication modules comprise a connecting communication module, a vertical communication module, and an external communication module that are connected to the control system.

* * * * *